US005816687A

United States Patent [19]

Tapp

[11] Patent Number: 5,816,687

[45] Date of Patent: Oct. 6, 1998

[54] METHOD AND APPARATUS FOR HANGING CHRISTMAS LIGHTS

[76] Inventor: F. Barry Tapp, 3101 Red Oak, Oklahoma City, Okla. 73120

[21] Appl. No.: 723,580

[22] Filed: Oct. 1, 1996

[51] Int. Cl.[6] ..... F21V 21/14

[52] U.S. Cl. ..... 362/250; 362/248; 362/374

[58] Field of Search ..... 362/145, 147, 362/238, 240, 248, 249, 250, 359, 374, 375

[56] References Cited

U.S. PATENT DOCUMENTS

| | | | |
|---|---|---|---|
| 2,975,271 | 3/1961 | Dvorak | 362/374 |
| 2,978,575 | 4/1961 | Cohen | 362/374 |
| 3,004,147 | 10/1961 | Lessner et al. | 362/374 |
| 3,692,993 | 9/1972 | Robinson | 362/249 |
| 3,697,743 | 10/1972 | Eargle | 362/374 |
| 3,705,301 | 12/1972 | Franklin et al. | 362/308 |
| 4,234,915 | 11/1980 | Malionwski et al. | 362/252 |
| 4,654,765 | 3/1987 | Laidman | 362/238 |
| 4,667,276 | 5/1987 | Cheng | 362/249 |
| 4,679,126 | 7/1987 | Van Sickler | 362/226 |
| 4,992,914 | 2/1991 | Heiss et al. | 362/153.1 |
| 5,359,506 | 10/1994 | Koleno | 362/248 |
| 5,510,966 | 4/1996 | Konecny | 362/249 |

*Primary Examiner*—Alan Cariaso
*Attorney, Agent, or Firm*—Robert Treece

[57] ABSTRACT

An apparatus for attaching a string of lights to a surface so the lights may selectively concealed or revealed. The apparatus includes a base for attachment to the surface and a removable cover or a hingable cap for selectively exposing the lights.

20 Claims, 4 Drawing Sheets

METHOD AND APPARATUS FOR HANGING CHRISTMAS LIGHTS

BACKGROUND OF THE INVENTION

FIELD OF THE INVENTION

The present invention relates to method and apparatus for hanging decorative lights on buildings.

Decorative lights are used on buildings for many reasons, the most common of which is probably to celebrate the Christmas season. While the displaying of lights is festive, attractive and very common, it can be a time consuming and even dangerous task to put up the lights and then remove them a few weeks later. In the case of residential Christmas lights, for several weekends prior to Christmas home owners are busy searching the attic for last year's lights. After the lights are located they must still untangle them, test them and replace all the bulbs which were broken when packing or unpacking. All this is done just so they can start climbing precariously around on ladders attaching the lights one by one to their houses. While various fastening means are employed, many if not most of them have the potential of damaging the electrical wire. Of course in a few weeks the ritual starts all over but in the reverse, the lights are removed and tucked away in the back of the attic or garage for the next year.

Some builders have helped by providing electrical outlets under the eaves of buildings and even having the plugs switched from the inside. However until the current invention no device has provided an attractive apparatus which will allow the lights to be displayed when desired and then without removing the lights, conceal them when they are not desired all without re-hanging the lights each year.

SUMMARY OF THE INVENTION

In view of the foregoing disadvantages inherent in the known types of light hangers now present in the prior art, the present invention provides a new construction wherein the same can be utilized reliably in those situations where one wishes to leave lights attached to a building but, have them concealed at times. As such, the general purpose of the present invention, which will be described subsequently in greater detail, is to provide a new and improved light hanger which has all the advantages of the prior art devices and none of the disadvantages.

To attain this, the present invention essentially comprises an elongated container with means for attaching a string of lights therein. The container may be opened to display the lights or closed to hide the lights.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved method and apparatus for hanging a string of lights which may be easily and efficiently manufactured and marketed.

It is a further object of the present invention to provide a new and improved method and apparatus for hanging a string of lights which is of a durable and reliable construction.

An even further object of the present invention is to provide a new and improved apparatus which is susceptible of a low cost of manufacture with regard to both materials and labor, and which accordingly is then susceptible of low prices of sale to the consuming public, thereby making such container economically available to the buying public.

Still another object of the present invention is to provide a new and improved method and apparatus for hanging lights which provides in the apparatuses and methods some of the advantages of the prior art, while simultaneously overcoming some of the disadvantages normally associated therewith.

Another object of the present invention is to provide a new and improved apparatus for hanging a string of lights wherein the lights may remain attached to a building, and be either concealed from view or displayed.

These together with other objects of the invention, and along with various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
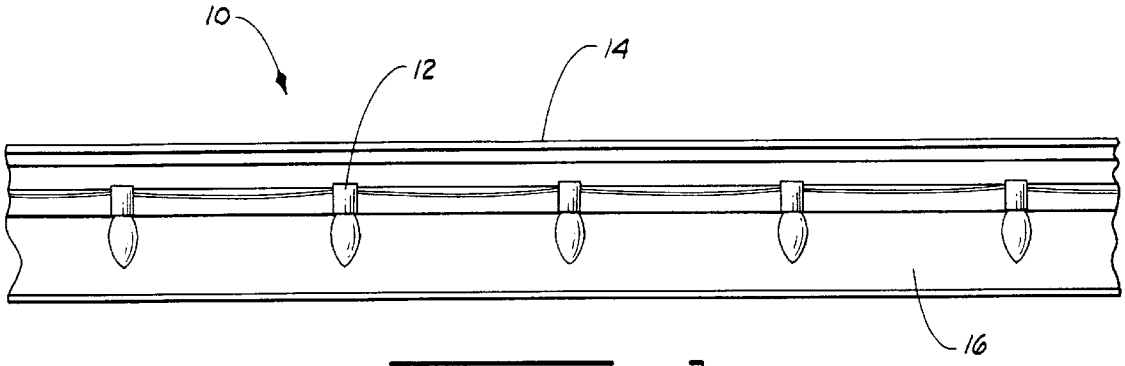
FIG. 1 is a front elevation of the light container constructed in accordance with the present invention.

Referring to the drawings in detail and to FIG. 1 in particular, reference character 10 generally designates an apparatus for hanging a string of lights constructed in accordance with the present invention and reference character 12 designates a string of Christmas lights. Christmas lights are used as an example of a string of lights which may be used with the invention, but other types and sizes of lights may also be used.

Figure 2:
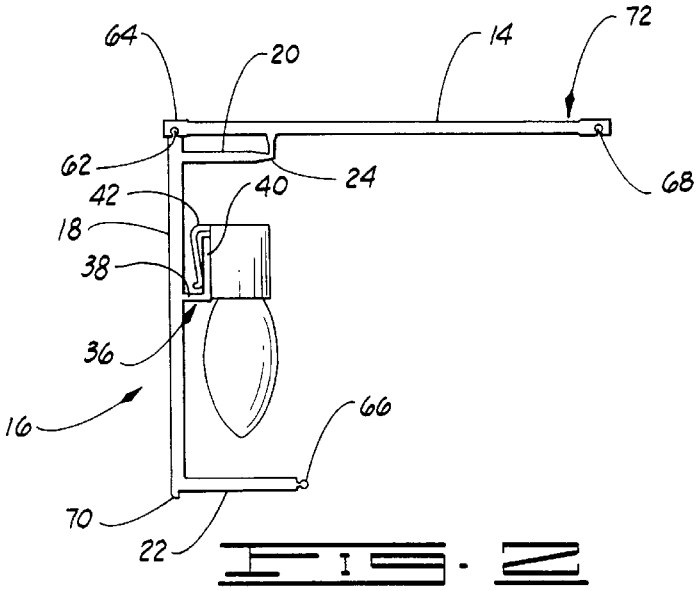
FIG. 2 is a side elevation of the light container of FIG. 1 with the container locked in the open position.

In a preferred embodiment the apparatus includes a base 14 and a cap 16. Preferably the cap 16 is pivotally attached to the base 14 so the cap may be moved from an open position, such as is shown in FIG. 2, to a closed position as is show in FIG. 4.

In the most preferred embodiment for use under the eave of a building, the cap 16 includes a cover base 18, a rear wall 20 and a front wall 22. The rear wall 20 includes a hinge portion 24 for pivotally attaching the cap 16 to the apparatus' base 14. In this way the cap 16 can be moved from an open position where the lights are exposed for display (FIG. 2), to a closed position (FIG. 4) where the lights are concealed. The hinge portion 24 can be made in several ways including: using hinges; thinning a portion of the rear wall 20 so it becomes flexible; making the rear wall 20 from a flexible material; using a ball and socket joint; or by inserting flexible material in a portion of the rear wall 20, to name but a few.

Figure 4:
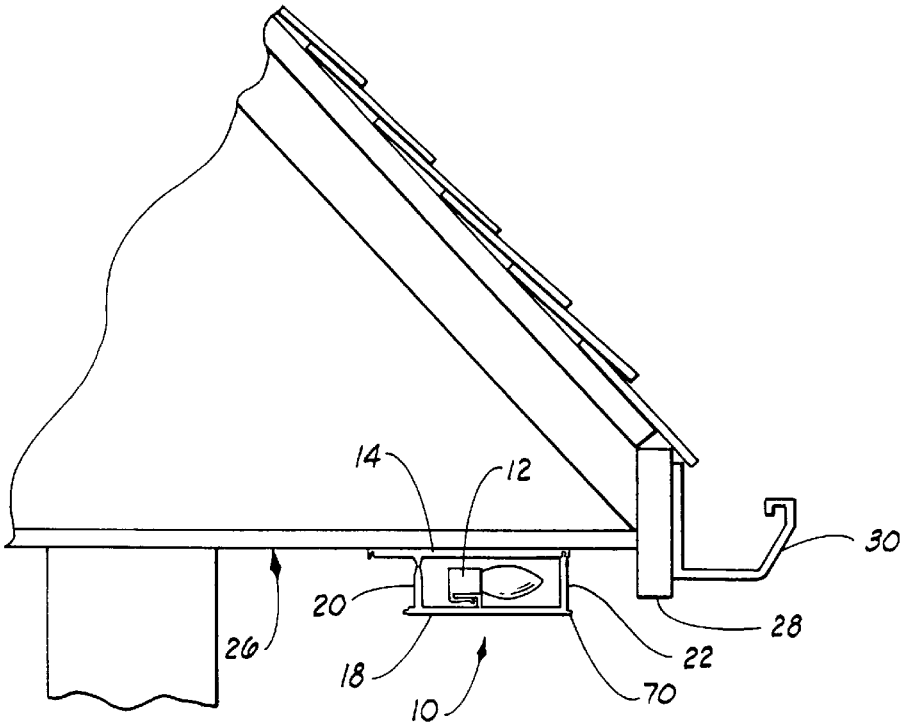
FIG. 4 is a side elevation of the light container of FIG. 1 with the container in a closed position and attached under a building's eave.

Referring now to FIG. 4, the apparatus 10 is shown connected under the eave 26 of a building. In this way the apparatus is usually, at least partially concealed by the building's fascia 28 and/or gutter 30 when the apparatus 10 is in the closed position. However, when the apparatus 10 is in the open position the lights 12 are fully visible.

The apparatus 10 may be attached to the building permanently or removably, however since lights may be concealed inside the apparatus 10, preferably the apparatus is attached permanently. In this way, the lights may be housed from year to year and all that is needed to display the lights is to open the apparatus and turn them on. One way to securely attach the apparatus 10 to a building is to send a plurality of fasteners through the base 14 of the apparatus 10 and into the building. For example screws, nails, brads, pop rivets, bolts, contact adhesive, glue, silicone, calk, or other similar connecting materials may be used to attach the apparatus 10 to the building.

Figure 5:
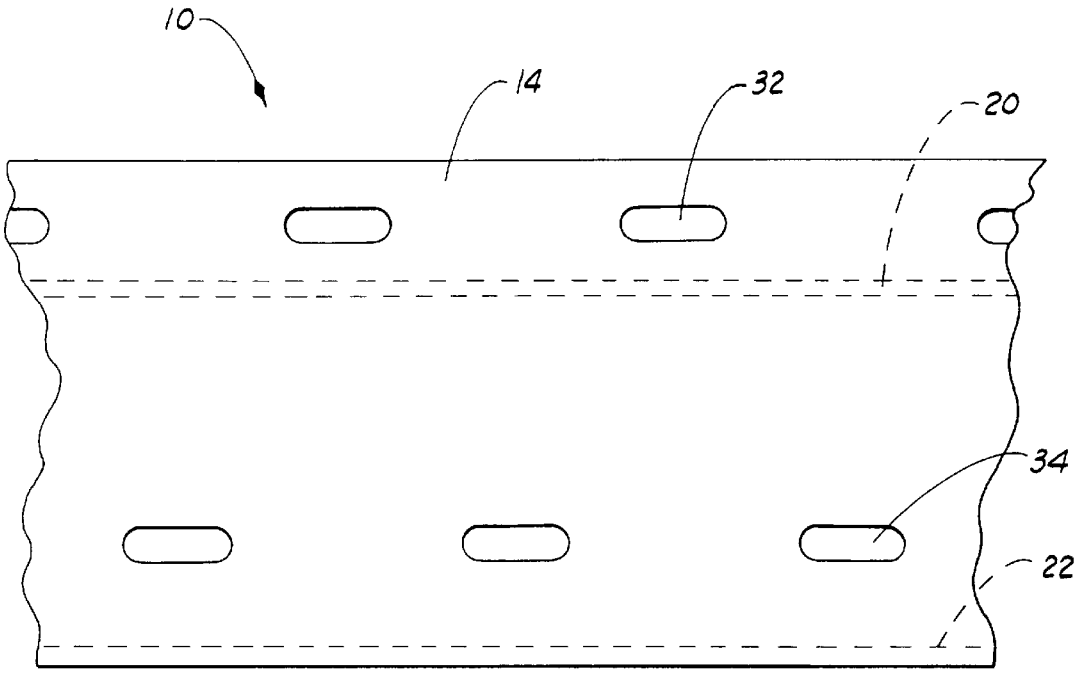
FIG. 5 is a top plan view of a portion of the container of FIG. 1, showing a portion of the base.

In the most preferred embodiment, the base 14 of the apparatus 10 is provided with apertures such as apertures 32 and 34 for screws (not shown) to attach the apparatus 10 to the building. Even more preferably the apertures 32 and 34 are elongated so the base may be moved slightly either length wise, (as shown in FIG. 5) or front and back (not shown) so the apparatus 10 may be aligned after a screw has been started. In addition, a series of elongated apertures should be provided so one may always find a location to insert a screw. While the apparatus is preferably made from a material which will allow one to insert a screw or nail through the material, the apertures make it easier to insert the screws or nails.

Figure 6:
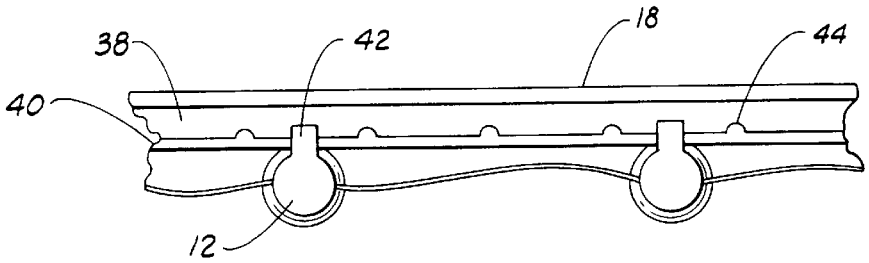
FIG. 6 is a view of one preferred means for attaching a string of lights to the container of FIG. 1.
Figure 7:
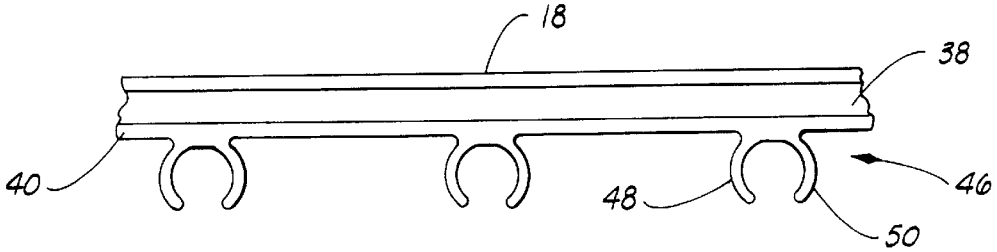
FIG. 7 is a view of another preferred means for attaching a string of lights to the container of FIG. 1.

Referring now to FIGS. 1, 6 and 7, the lights 12 may be attached to the apparatus 10 in several different ways. The preferred embodiments include an interior ledge 36 having a base 38 and an arm 40. Since most lights 12 include clips 42, the lights 12 may simply clip to the arm 40 and thereby be held in place. To help keep the lights from sliding up or down the ledge 40, bumps (such as bump 44, only one being referenced in FIG. 6) may be provided. The bumps provide a thickened area on the ledge 40 which will reduce the likelihood that a clip 42 will slide any appreciable distance up or down the ledge 40. FIG. 7 shows another preferred embodiment having U shaped claws 46 into which the lights 12 may be inserted. This embodiment will secure lights even if the lights 12 do not include clips 42. The claws 46 preferably have left and rights sides 48 and 50 made of a flexible material so the light socket may be inserted between the sides and thus, held thereby. The claws 46 are preferably spaced at equal distances along the length of the apparatus 10 at a distance which corresponds with the standard distance between lights on a strand. However, in some cases it may be preferable to space the claws at a distance shorter than the standard light separation distance. This will provide the ability to attach nonstandard lights, to space the lights closer together or to even skip some claws 46 when attaching lights.

Figure 3:
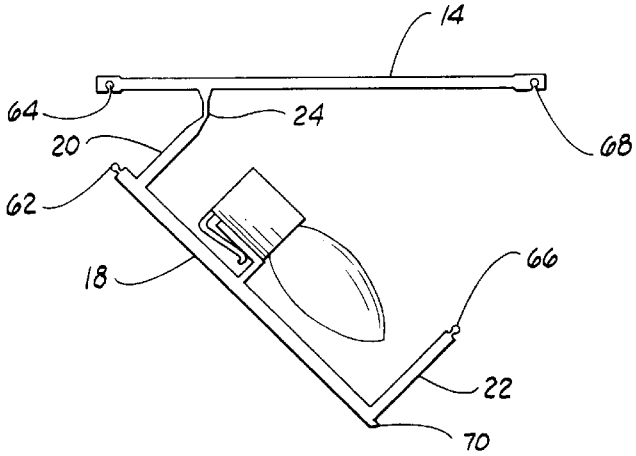
FIG. 3 is another side elevation of the light container of FIG. 1 with the container in a slightly open position.

Preferably the apparatus includes means for locking the cap 16 in an open and a closed position. One suitable means is shown in FIGS. 2 and 3. The locking means includes pairs of protrusions and a grooves, such as protrusions 62 and 66 and grooves 64 and 68. These protrusions and grooves may be in the form of ball and socket connectors with the edges of the socket flexing apart when the ball is pushed in and thus holding the ball in the socket. Since the cap 16 snaps in a closed position, a ridge 70 may be provided to aid the user in grasping and opening the cap 16.

It may be preferable to thicken the base 14 around the areas which contain grooves 64 and 68. This thickening provides additional material to strengthen the sides of the grooves and thereby provides greater holding strength. In addition the thickened area may extend above the plain of the upper side of the base as is indicated by reference character 72 (FIG. 2). In this way the majority of the base 14 is spaced slightly away from the surface on which it is mounted, so the base will not be effected by minor irregularities in the mounting surface.

Figure 8:
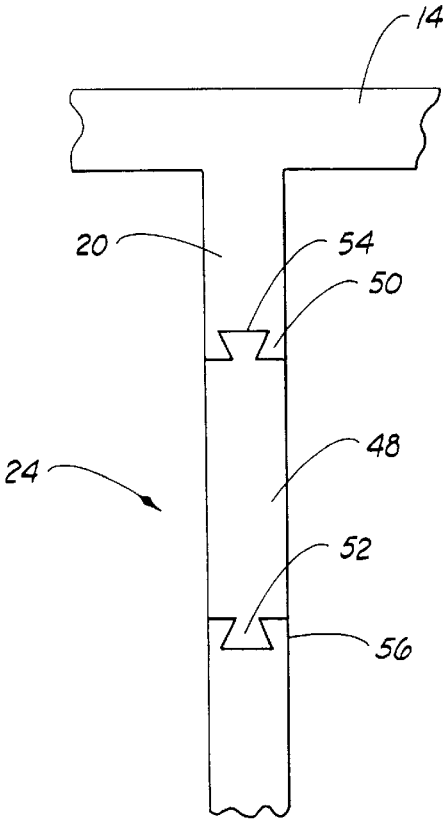
FIG. 8 is a view of one preferred embodiment for a hinge area of the container of FIG. 1.

FIG. 8 shows one embodiment for providing a hingable portion 24 in the rear wall 20. It should be noted that the preferred embodiment is to have the rear wall 20 made from a flexible material and to thin the rear wall 20 in the area where it is to hinge, however in some locations this thinning may cause the rear wall to crack after repeated use. In those locations it is preferable to provide a flexible insert or a conventional hinge in the rear wall 20. In FIG. 8 a flexible insert 48 is shown in the rear wall 20. One way to connect the flexible insert 40 is to provide mating protrusions and grooves which interlock to secure the insert 40. For example the insert may include protrusions 50 and 52 which engage the grooves 54 an 56 in the rear wall 20 to lock the hingable portion to the rear wall. Of course the grooves and protrusions may be reversed so that the grooves are in the flexible portion and the protrusions are on the rear wall. However the former is preferred since it has been found to provide a stronger connection.

Figure 9:
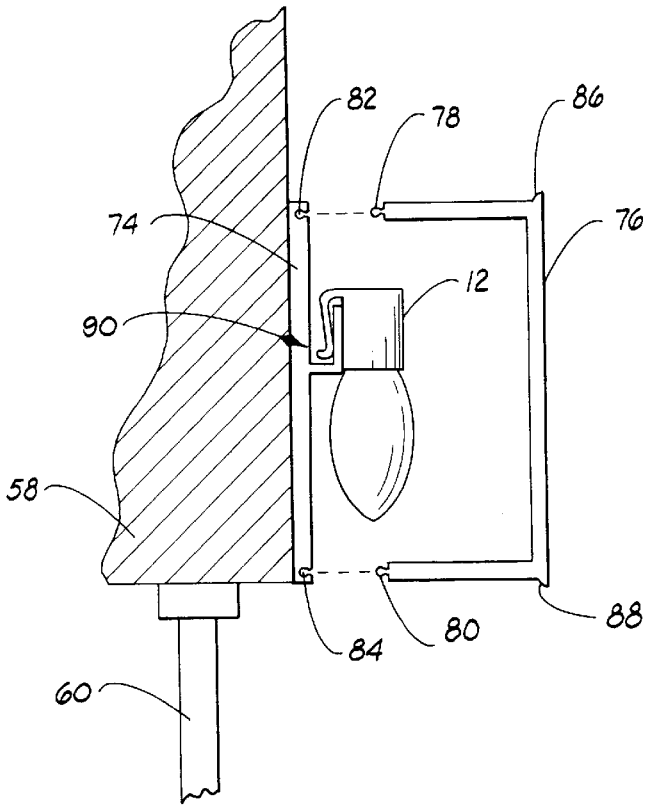
FIG. 9 is another preferred embodiment of the is light container constructed in accordance with the present invention.
Figure 10:
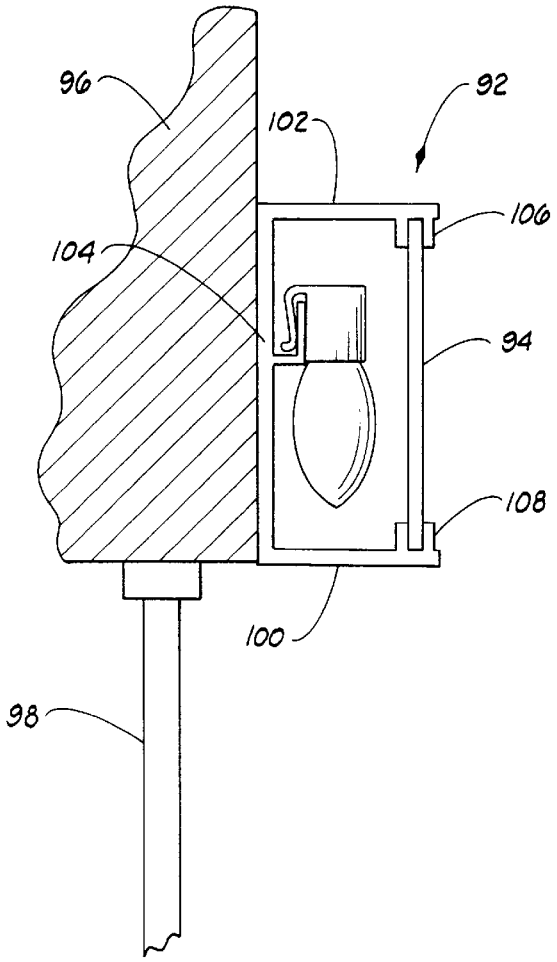
FIG. 10 is yet another preferred embodiment of the light container constructed in accordance with the present invention.

In some situations it may be preferable for the apparatus to have a removable cap, FIG. 9 shows one such removable cover and FIG. 10 shows another type of removable cap. On a wall 58 such as near a window 60 it is preferable for the cap to be removed when one wants to display the lights. One way to accomplish this is to have a base 74 with a snap on, snap off cap 76. One means for providing the snap on, snap off ability is to provide ball and socket means for connecting the cap 76 to the base 74. Such balls and sockets are referenced as characters 78–80 and 82–84 respectively. It is also preferable to provide means for grasping the cap 76 so it may be easily removed. One such suitable means includes one or more ridges (such as ridges 86 and 88) on the cap 76. Means 90 for attaching lights 12 similar to those described above in relation to the apparatus 10 may also be provided.

Figure 11:
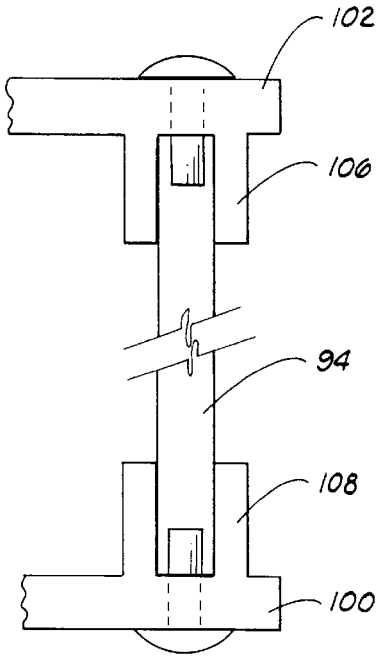
FIG. 11 is a cross-sectional view of one embodiment of the cover for the container of FIG. 10.
Figure 12:
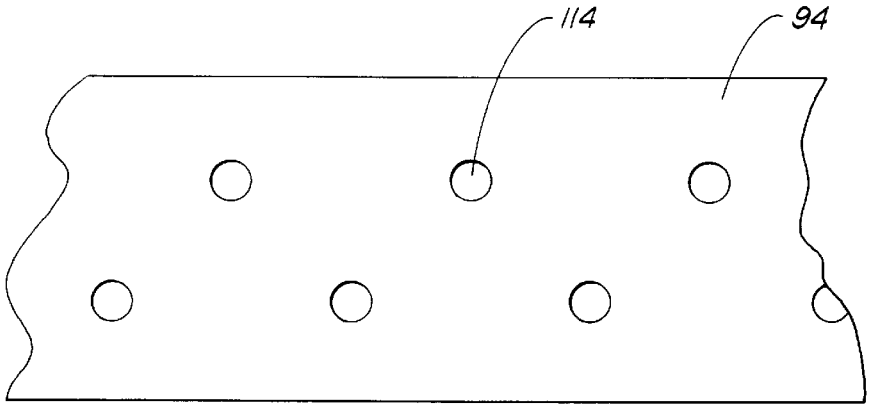
FIG. 12 is a view of a portion of a cover for the container of FIG. 10.

FIGS. 10–12 shows yet another embodiment of the apparatus 92 with a removable cover 94. This embodiment is particularly usefull for flat wall locations which are high or difficult to reach. It is also useful around windows where a removable cover may be desired. FIG. 10 shows the apparatus 92 mounted on a wall 96. A window 98 is shown near by, but it should be understood that this embodiment is also useful on a surface whether or not a window is near. Some examples of such locations include, but are not limited to the roof of a building and the facie. With this embodiment sides 100 and 102 are permanently connected to the base 104. The cap 94 slides into channels 106 and 108 to secure the cover 94 onto the apparatus 92 when the lights are to be concealed.

Means should be provided to prevent the cover 94 from sliding unless and until removal is desired. FIG. 11gives one example of a suitable means for securing the cover 94. In this example pins 110 and 112 are inserted through the sides 100 and 102 to block the movement of the cover 94. The pins should be located at the lower end of a strip of the apparatus which is mounted other than horizontally, in this way it will be easer for one to remove the pins when the cover is to be removed.

A tool, such as a pole with a hook on the end may be used to aid one with removing the cover 94. In such a case it is particularly helpful for removing the cover 94 when it is mounded in a high location. When using a tool it is preferable for the cover 94 to have irregularities, bumps, or holes in its surface to provide a location for the tool to grasp the cover 94. One example of such is shown in FIG. 12 wherein the cover 94 is shown with a series of small holes 114 onto which a tool could grasp to aid in removing or installing the cover.

Changes may be made in the combinations, operations and arrangements of the various parts and elements described herein without departing from the spirit and scope of the invention as defined in the following claims.

I claim:

1. An apparatus for hanging lights comprising:

an apparatus base for attaching to a surface;

a cap having a first side a second side and a cap base, the first side being integral with the cap base and including a hinge for hingably connecting the cap and the apparatus base, and the second side being integral with the cap base, wherein the cap is movable from a closed position where the second side is adjacent the apparatus base to an open position wherein the second side is away from the apparatus base;

means for releasably connecting the second side to the apparatus base when the cap is in the closed position; and means on the apparatus base and the first side for releasably connecting the first side to the apparatus base when the cap is in the open position to hold the cap in the open position.

2. The apparatus of claim 1 wherein the means for releasably connecting the second side to the apparatus base when the cap is in the closed position comprises: a protrusion and a groove for mating engagement when the cap is in the closed position.

3. The apparatus of claim 2 wherein the groove is a socket and the protrusion is generally in the shape of a ball.

4. The apparatus of claim 3 wherein the socket is part of the apparatus base and wherein the portion of the apparatus base having the socket is thickened relative to the remaining portion of the apparatus base.

5. The apparatus of claim 1 wherein the hinge comprises a portion of the first side which is thinner than the remainder of the first side to provide a flexible portion of the first side.

6. The apparatus of claim 1 further comprising means for connecting lights to the apparatus.

7. The apparatus of claim 6 wherein the means for connecting lights to the apparatus includes an interior ledge having a base integral with an arm, said ledge base being connected to and extending from said cap.

8. The apparatus of claim 6 wherein the means for connecting lights to the apparatus includes a plurality of claws each claw being connected to and extending from said cap.

9. The apparatus of claim 1 wherein the hinge comprises a portion of flexible material inserted into and making up a part of the first side.

10. The apparatus of claim 1 further comprising a plurality of apertures in the apparatus base for facilitating the securing of the apparatus base to a surface.

11. The apparatus of claim 10 wherein the apertures are elongated.

12. The apparatus of claim 1 further comprising a protrusion on the second side to provide a location for one to grasp the cap when opening the cap.

13. An apparatus for hanging lights comprising:

an apparatus base for attaching to a surface;

a cap having a first side a second side and a cap base, the first side being integral with the cap base and including a hinge for hingably connecting the cap and the apparatus base, wherein the hinge comprises a portion of the first side which is thinner than the remainder of the first side to provide a flexible portion of the first side, and the second side being integral with the cap base, wherein the cap is movable from a closed position wherein the second side is adjacent the apparatus base to an open position wherein the second side is away from the apparatus base;

means for releasably connecting the second side to the apparatus base when the cap is in the closed position; and means for releasably connecting the first side to the apparatus base when the cap is in the open position.

14. The apparatus of claim 13 wherein the means for releasably connecting the first side to the apparatus base when the cap is in the open position comprises: a protrusion extending from the first side and a groove in the base for mating engagement when the cap is in the open position.

15. The apparatus of claim 13 further comprising means for connecting lights, and wherein the means for connecting lights to the apparatus includes an interior ledge having a base integral with an arm, said ledge base being connected to and extending from said cap.

16. The apparatus of claim 13 further comprising means for connecting lights, and wherein the means for connecting lights to the apparatus includes a plurality of claws each claw being connected to and extending from said cap.

17. The apparatus of claim 13 further comprising a plurality of apertures in the apparatus base for facilitating the securing of the apparatus base to a surface.

18. The apparatus of claim 13 further comprising a protrusion on the second side of said cap to provide a location for one to grasp the cap when opening the cap.

19. An apparatus for hanging lights comprising:

an apparatus base for attaching to a surface;

a cap having a first side a second side and a cap base, the first side being integral with the cap base and including a hinge for hingably connecting the cap and the apparatus base, and the second side being integral with the cap base, wherein the cap is movable from a closed position where the second side is adjacent the apparatus base to an open position wherein the second side is away from the apparatus base, and wherein the hinge comprises a portion of flexible material inserted into and making up a part of the first side;

means for releasably connecting the second side to the apparatus base when the cap is in the closed position; and means for releasably connecting the first side to the apparatus base when the cap is in the open position.

20. The apparatus of claim 19 wherein the means for releasably connecting the first side to the apparatus base when the cap is in the open position comprises: a protrusion extending from the first side; and a groove in the base for mating engagement when the cap is in the open position.

* * * * *